US007160183B2

(12) United States Patent
Weber

(10) Patent No.: US 7,160,183 B2
(45) Date of Patent: Jan. 9, 2007

(54) BUFFING TOOLS AND METHODS OF MAKING

(75) Inventor: Robert J. Weber, Hickory, NC (US)

(73) Assignee: Jason Incorporated, Conover, NC (US)

( * ) Notice: Subject to any disclaimer, the term of this patent is extended or adjusted under 35 U.S.C. 154(b) by 242 days.

(21) Appl. No.: 10/431,764

(22) Filed: May 8, 2003

(65) Prior Publication Data

US 2003/0194962 A1 Oct. 16, 2003

Related U.S. Application Data

(62) Division of application No. 09/703,087, filed on Oct. 31, 2000, now Pat. No. 6,595,843.

(51) Int. Cl.
*B24D 11/00* (2006.01)

(52) U.S. Cl. ..... 451/532; 28/104; 451/533; 451/536

(58) Field of Classification Search ..... 15/230.12, 15/230.15; 28/104; 51/293, 297; 451/526, 451/532, 533, 536
See application file for complete search history.

(56) References Cited

U.S. PATENT DOCUMENTS 5,989,113 A * 11/1999 Arnold ..... 451/532
RE37,295 E * 7/2001 Heerten et al. ..... 428/213
6,595,843 B1 * 7/2003 Weber ..... 451/532
2004/0014388 A1 * 1/2004 Baert et al. ..... 442/327

* cited by examiner

*Primary Examiner*—Timothy V. Eley
(74) *Attorney, Agent, or Firm*—Renner, Otto, Boisselle, & Sklar LLP

(57) ABSTRACT

A buff is made from a non-woven fabric where the fibers are first carded and formed into a fairly thick fleece. The fleece is passed over a topographical surface on, for example, a moving belt or a drum. The fleece is subject to a bow-tie hydroentanglement process where many fine jets of water entangle the fibers on the topographical surface. Excess water is vacuumed from the system. The fabric is dried and chemically treated. With the fabric a variety of buffing tools are made, in wheel, belt or roll form. Tests against standard and mill treatment buffs show a remarkably lower fabric weight loss percentage and lower or normal operating temperatures. The fabric has exceptional mechanical strength having a tensile strength in excess of 650 N/50 mm according to DIN 29073/3. Preferably the fabric has a tensile strength of at least 1,000 N/50 mm in the machine direction and in excess of 900 N/50 mm in the cross direction according to such DIN.

15 Claims, 5 Drawing Sheets

BUFFING TOOLS AND METHODS OF MAKING

CROSS-REFERENCE TO RELATED APPLICATION

This application is a division of U.S. patent application Ser. No. 09/703,087, filed Oct. 31, 2000 now U.S. Pat. No. 6,595,843.

DISCLOSURE

This invention relates generally as indicated to a buffing tools and methods of making such tools, and more particularly to buffing tools having improved fabric or cloth greatly enhancing the efficiency, useful life, and productivity of the tool.

BACKGROUND OF THE INVENTION

Buffing tools probably are embodied most commonly in the form of a wheel. The wheel includes one or more discs or plates providing an arbor hole. The cloth or fabric is secured to and projects radially from the discs. The projecting edge of the fabric is the working face of the tool. Several layers or plys of fabric may be provided for each wheel and the fabric may be folded, bunched, puckered, or pleated so that the fabric edge zig-zags back and forth at the face, and the working face of the tool may be substantial axially wider than the discs or plates, from which the fabric projects.

The wheels may be stacked on arbors with or without spacers to form buffing rolls or units which are mounted to the required axial length. The rolls may be of substantial axial length.

Other forms of wheel buffs may be formed by wrapping or folding the fabric around a core ring to project radially outwardly with the folded portion of the fabric held by a clinch ring. The clinch ring may include teeth biting into the fabric radially beyond the core ring. The clinch ring may be secured to a core plate or disc, or may be stacked and clamped directly on arbors.

Some rotary or wheel buffs are made without the core plates and clinch rings. Each superimposed buff fabric layer is simply sewn together usually with annular rows of stitching around a central hole. In addition other sewing may be included. The wheel sections are aligned and clamped on arbors.

Another form of buff is that which is known as a flap wheel. The buff fabric in one or more layers is formed into flaps which are usually closely spaced and secured to a rotary hub. The edges of the flaps extend generally parallel to the axis of rotation of the hub in contrast to other wheel tools where the edge of the fabric extends generally circumferentially of the axis of rotation albeit irregularly.

Instead of the fabric being secured to wheels, discs, or hubs, the fabric may be secured to flexible belts to be trained about at least two pulleys, one of which is power driven.

Tools such as those described above are generally available from JacksonLea, a unit of Jason Inc. in Conover, N.C., USA and are sold under well known trademarks such as CHURCHILL® and JACKSON™.

The fabric of these power driven tools is of course the part of the tool which engages the work and the part of the tool which wears. The tools are rotated at variable speeds. Arbor and S.FM speed selection choices are a result of finishing considerations such as, part configuration, stock removal requirements, type of finish, heat generation, output requirements and others. The movement of the fabric over the work may create significant heat both in the work and in the fabric. It has been found generally that such heat can be deleterious to both. An exception is aluminum where high heat usually achieves best results. This is usually obtained by higher speeds and pressures.

Also, the fabric may be treated, or the treatment may be applied to the working face in bar, stick or spray (liquid) form, depending on the finish desired. The treatments used may vary widely depending on the material being buffed and the finish desired.

For example, buffing may have at least three classifications which are: cut-down buffing, for producing a preliminary smoothness; cut and color buffing for producing smoothness and some lustre; and color buffing for the production of high gloss or a mirror finish.

Other varieties of finishes may be provided. For example, a satin finish may include scratch brush, butler, satin, colonial, matte, antique, sanded finishes, and others.

Abrasives applied may vary widely from water and bran meal to rouges, Tripoli, to a wide variety of color compounds. Some are applied with grease sticks or bars, while others are greaseless. Regardless, excess heat may adversely affect the treatment and its application and makes it difficult to achieve the results desired.

One way the heat problem has been addressed is to use what is known as ventilated buffs. These are buffs which are constructed to obtain a cooling flow of air as the buff rotates. In some cases a liquid coolant may be used similar to machine tool operations, but this creates problems in circulation and filtration. Such systems are usually a costly mess.

As far as the cloth or fabric is concerned the efforts to reduce heat generation have logically followed efforts to produce a lighter more open fabric but this generally universally results in fabrics of less strength and less wear resistance. The fabric is after all the wear-away part of the tool. A new wheel may have less than 1 or more than 30 inches of projecting fabric. The worn wheel may be recycled by supplying it with new fabric, it can be used as a spacer ring in a buff roll, but more normally it is simply tossed or scrapped.

A wheel with too much wear creates productivity problems. The machinery has to be stopped and the wheel replaced with a new one. A replaced wheel may exhibit non-uniform buffing until the wheel has had a chance to break in or conform to the shape of the part. Wheel replacement becomes necessary when the finish is no longer satisfactory. Wheel diameter take off size varies greatly. All of this results in downtime and excessive tooling costs.

It would accordingly be desirable if buffing tools could be made with cool running fabric, yet with a fabric having significantly higher strengths and much higher wear resistance even where heat is desired providing longer more productive tool life, machine-up time and lower overall finishing costs.

SUMMARY OF THE INVENTION

It is a principal object of the invention to provide a buff which will not generate excessive heat adversely affecting the work, or treatments, or the buff itself, and which will have a substantially longer working life. Yet it is also important that the buff have good wear resistance in high heat application. It is also important that the fabric of the buff be light weight and yet have an exceptional mechanical strength. To achieve these ends the fabric should have a tensile strength in both the machine and cross direction of the fabric in excess of 650 N/50 mm according to DIN EN 29073/3. More remarkably the fabric may have a mechanical strength two or more times the minimum noted and for example in excess of 1,000 N/50 mm according to the noted DIN.

The fabric is made by a bow-tie hydroentanglement process using a selected topographical surface. The fibers of the non-woven fabric are carded to form a fairly thick fleece which then continuously passes over a moving belt or drum providing a selected topographical surface. On such surface the fleece is subjected to impingement by many minute jets of water. This compacts the fleece and tightly entangles the fibers in the topographical pattern. Excess water is vacuumed away from the interior of the belt or drum. The tightly compacted and entangled fiber is then removed from the belt of drum to pass through a drier and to be treated. The fabric in bolts or rolls is then fabricated into buffing tools, such as noted above. These tools may include a wide variety of wheels, wave ring buffs, finger buffs, contoured buffs, airway buffs, flap wheels, sewn buffs, spiral-roll buffs, stacked buff rolls, or flexible belts.

Even though the surface speed may be substantial, buffs of the present invention exhibit remarkable useful life with minimal generation of heat. Even where high heat is desired, the buff provides an extended useful life.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
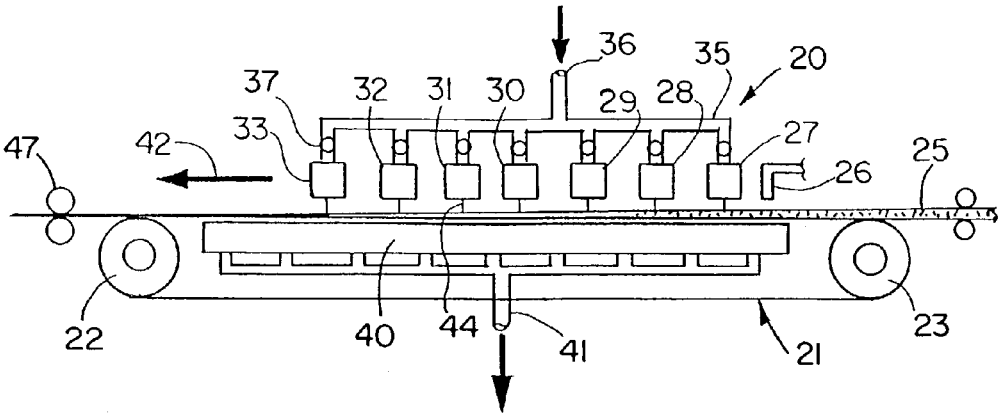
FIG. 1 illustrates one form of apparatus for making the topographical fabric of the present invention using a moving topographical belt.

Referring initially to FIG. 1 there is illustrated one form of apparatus for making the non-woven fabric of the present invention. The apparatus shown generally at 20 comprises a porous topographical belt 21 which is trained over two rolls indicated at 22 and 23. The selected fibers from bales are passed through a carding machine to form a relatively thick and somewhat lofty fleece layer of fibers shown generally at 25 passing onto the upper surface of the topographical belt 21. The continuously moving foraminous topographical belt supports the layer or fleece of fibers. The fleece initially passes beneath a nozzle 26 which wets the fleece. After being soaked the fleece passes beneath a series of spray boxes seen at 27, 28, 29, 30, 31, 32 and 33 to which water under pressure is fed by manifold 35 from source 36. Each spray box includes a pressure adjustment valve 37 so that the pressure of the water within the boxes may be controlled.

A vacuum manifold shown generally at 40 is positioned beneath the upper reach of the topographical belt below the spray boxes and removes excess water from the fabric being formed as it is subjected to the hydroentanglement process. The fabric is moving in the direction of the arrow 42 which is known as the machine direction (MD) of the fabric. The direction normal to the viewer in FIG. 1 is known as the cross-direction (CD).

Each of the spray boxes has one or more rows of very fine diameter orifices, such as on the order of about 0.005 to about 0.008 inches with thirty or more orifices per inch in each row. Water is supplied to the spray boxes under a selected pressure and is ejected from the orifices in the form of a very fine substantially columnar non-diverging stream or jet as shown at 44. Preferably the jet pressure of the hydroentanglement process increases as the fibers move from right to left in FIG. 1. For example the pressure may increase from about 100 psi to in excess of 1,000 psi.

This increasing pressure is obtained by the adjustment controls 37. It is noted that the spray boxes should be kept as close as possible to the fibrous web passing on the topographical belt therebeneath. If the distance is too great, the columnar configuration of the sprays 44 tends to dissipate or disperse and the entanglement process is not as effective. The distance between the fibrous web layer and the undersurface of the spray boxes should be on the order of an inch or less. In the process as will be seen, the fairly thick layer of fleece becomes compacted when it is thus entangled on the topographical surface and it becomes much thinner. It is also noted that the vacuum boxes 40 extend well beyond the spray boxes so that excess water is pulled from the fabric. The now dense entangled fibers forming the fabric are passed through pinch rolls shown at 47 to pass through a suitable drier, then to be treated, and finally formed into bolts or rolls for delivery to the buff fabrication process.

Figure 2:
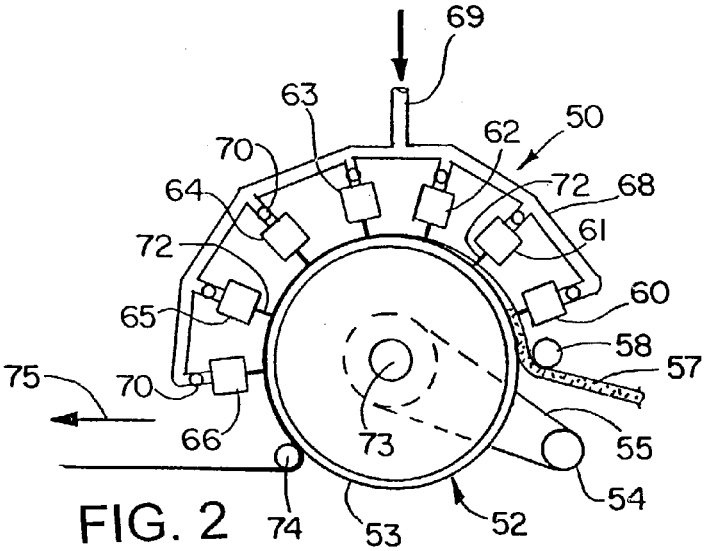
FIG. 2 illustrates another form of apparatus for making the topographical fabric of the present invention using a rotating topographical drum.

FIG. 2 illustrates a similar process shown generally at 50 but utilizing a rotary drum 52 which contains the foraminous or porous topographical surface 53. The drum is driven for rotation by motor 54 through drive belt 55.

The relatively thick fibrous fleece material from the carding machine enters the machine at 57 and passes beneath roll 58 which places the fleece on the drum surface.

The fleece then passes internally beneath circularly arranged spray boxes 60, 61, 62, 63, 64, 65, and 66. The spray boxes are fed by manifold 68 from source from 69. Each spray box includes a pressure control shown generally at 70. The spray boxes are constructed as in FIG. 1 with one or more rows of very fine orifices very closely spaced directing columnar spray jets at the fibers supported on the foraminous topographical drum. These columnar sprays shown generally at 72 are preferably under a higher pressure as the fleece or fabric layer progresses in a counterclockwise direction around the drum as illustrated. The interior of the drum is under vacuum and excess water may be drawn from the drum through the axial port indicated at 73. The densified and entangled fabric is removed from the drum by the peel off roller 74 and moves in the direction of the arrow 75 to a drier and for treatment.

The preferable treatment is an application which contains acrylic binders, melamine resin, and wetting agents. After such treatment the fabric in bolts or rolls is shipped for fabrication of the buffs of the present invention. As with FIG. 1, the arrow 75 indicates the machine direction (MD) of the fabric while the direction normal to the viewer is the cross-direction (CD).

Figure 3:
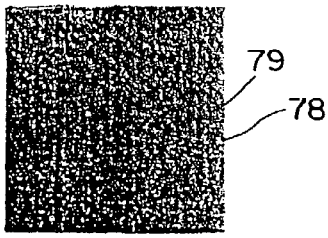
FIG. 3 is an illustration of a mini-herringbone topographical light weight high strength fabric used to form the tools of the present invention.

Referring now to FIG. 3 there is illustrated at 78 a section of fabric in accordance with the present invention in what may be described as a mini-herringbone topography. The topography is of course determined by the topography of the belt or drum of the apparatus of FIGS. 1 and 2. The fabric comprises a multiplicity of closely spaced yarn-like fiber bundles which are interconnected at junctures 79. Each of the fiber bundles comprises fiber segments which have been densified and highly compacted, and even though the junctures are closely spaced, the fiber bundle includes a further entangled area between junctures where the fibers tend to be wrapped around the periphery of the parallel compacted fiber bundles or segments. This further entanglement between junctures is known as a bow-tie entanglement and produces a strong dense yet light weight fabric.

Figure 4:
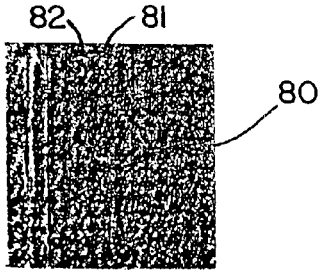
FIG. 4 is a similar illustration of the high strength light weight fabric with an octagon/squares topography.

FIG. 4 illustrates at 80 another example of a fabric in accordance with the present invention. The pattern illustrated in FIG. 4 is what is known as an octagon/squares pattern. The process is still a bow-tie entanglement process and the yarn-like bundles of fibers are joined at junctures such as seen at 81 surrounded by an octagonal arrangement of further junctures or squares. Again the bow-tie or intermediate entangling process is employed to form the octagon/squares pattern illustrated.

The fibers used to form the fiber of the present invention may vary in length from a quarter of an inch to an inch and a half or more and a wide variety of synthetic or natural fibers may be employed. Natural fibers may include wool or mohair as well as cotton, linen, hemp or sisal. Synthetic fibers may include polyester, polyamide, polypropylene, polyethylene terephthalate (PET), acrylics or even aramids. The fiber may also be recycled. It is however important that the fiber have good tensile strength and that the fiber or fiber blend should not be selected which would detract from the mechanical strength of the fabric.

After the fabrics are produced, it is important that they be subject to mechanical testing to ensure that they have the mechanical strengths of the present invention in order to produce the relatively cool running wear resistant buffs of this invention.

It is important that the fabric meet certain specifications such as those set forth below.

Strength Specification

| COMPOSITION | 100% Polyester |
|---|---|
| Weight, oz/yd$^2$ | 2.5–4.5 |
| Grab Tensile, N/50 mm to DIN EN 29 073/3 (Supercedes DIN 53 857/2) | |
| MD (Machine Direction) | 700+ |
| CD (Cross Direction) | 650+ |
| Elongation, % to DIN EN 29 073/3 (Supercedes DIN 53 857/2) | |
| MD | 30–48 |
| CD | 55–75 |
| Grab Tensile, lbs ASTM D5034 | |
| MD | 80–110 |
| CD | 50–75 |
| Elongation, % | |
| MD | 30–48 |
| CD | 55–75 |
| Strip Tensile, lbs ASTM D5035 | |
| MD | 25–45 |
| CD | 20–45 |
| Elongation, % | |
| MD | 30–40 |
| CD | 55–75 |
| Thickness 1ply, mils ASTM D5729 | 17–25 |
| Elmendorf Tear, grams ASTM D5734 | |
| MD | 1,200–1,500 |
| CD | 1,100–1,450 |
| Absorbency ASTM D1117 (Section 21) | |
| Capacity, % | 350–600 |
| Time, sec. | 1.3 |
| Mullen Burst, psi ASTM D461 (Section 13) | 120+ |
| Air Permeability, cfm/in. ASTM D737 | 150+ (4 mm) |
| Taber Abrasion, cycles ASTM D3884 | 900+ |
| Surface Abrasion, @ 12 kPA pressure, cycles BS 5690:1988, Martindale | 38,000+ |

One of the more important tests is the grab tensile strength test according to DIN EN29073/03 which has superceded DIN 53857/2. It is important that the tensile strengths in both the machine and cross-direction as indicated be in excess of 650 N/50 mm. It is also important that the weight of the fabric be relatively light weight such as the 2.5 to 4.5 ounces per square yard indicated.

With the specifications in mind, the following are specific examples of fabrics made as described above and subjected to the various DIN and ASTM tests noted:

EXAMPLE 1

| COMPOSITION: 100% POLYESTER PAD DYED MUSTARD<br>DESIGN: OCTAGON/SQUARES | |
|---|---|
| PHYSICAL PROPERTIES | |
| WEIGHT, oz/yd$^2$ | 3.5 |
| THICKNESS (1 ply, mils) | 25.6 |
| TENSILE, lbs | GRAB STRIP EN DIN, N/50 mm |

-continued

| COMPOSITION: 100% POLYESTER PAD DYED MUSTARD DESIGN: OCTAGON/SQUARES | | | |
|---|---|---|---|
| MD | 93.4 | 43.8 | 1647.1 |
| CD | 72.5 | 31.7 | 1396.7 |
| ELONGATION % | | | |
| MD | 41.2 | 44.3 | 38.7 |
| CD | 62.7 | 67.8 | 57.4 |
| MULLEN BURST, (psi) | | | 134 |
| TABER ABRASION (cycles to fail) | | | 3000+ |
| TEAR STRENGTH | Elmendorf, gms | | Trapezoid, lbs |
| MD | 2782 | | 37.3 |
| CD | 3248 | | 48.3 |
| ABSORBENCY | | | |
| CAPACITY (%) | | | 470 |
| TIME (sec) | | | 1.8 |

EXAMPLE 2

| COMPOSITION: 100% POLYESTER HIGH ABRASIVE FINISH DESIGN: MINI-HERRINGBONE | |
|---|---|
| PHYSICAL PROPERTIES | |
| WEIGHT, oz/yd$^2$ | 3.7 |
| THICKNESS (1 ply, mils) | 36 |
| TENSILE, N/50 mm to DIN EN 29 073 | |
| MD | 1947.0 |
| CD | 1625.0 |
| ELONGATION, % to DIN EN 29 073 | |
| MD | 76.0 |
| CD | 108.7 |
| ABSORBENCY | |
| CAPACITY, % | 649 |
| TIME, sec. | 1.6 |
| TABER ABRASION (cycles to fail) | 4000+ |
| MULLEN BURST, psi | 75.2 |
| AIR PERMEABILITY, 6 mm | 348 |
| SURFACE ABRASION @ 12 kPA pressure, cycles BS 5691:1988, Martindale | 45,000 |

EXAMPLE 3

| COMPOSITION: | 100% PET |
|---|---|
| DESIGN: OCTAGON/SQUARES | |
| WEIGHT, oz/yd$^2$ | 3.5 |
| GRAB TENSILE, N/50 mm to DIN EN 29 073 | |
| MD | 1538.5 |
| CD | 1312.0 |
| ELONGATION, % to DIN EN 29 073 | |
| MD | 38.8 |
| CD | 65.4 |
| GRAB TENSILE, lbs ASTM D5034 | |
| MD | 95.38 |
| CD | 65.24 |

-continued

| COMPOSITION: | 100% PET |
|---|---|
| ELONGATION, % | |
| MD | 37.04 |
| CD | 66.96 |
| STRIP TENSILE, lbs ASTM D5035 | |
| MD | 35.25 |
| CD | 28.26 |
| ELONGATION, % | |
| MD | 39.23 |
| CD | 66.21 |
| THICKNESS, 1 ply, mils ASTM D5729 | 21.5 |
| ELMENDORF TEAR, grams ASTM D5734 | |
| MD | 1393 |
| CD | 1213 |
| ABSORBENCY ASTM D1117 (Section 21) | |
| CAPACITY, % | 497 |
| TIME, sec. | 1.3 |
| MULLEN BURST, psi ASTM D461 (Section 13) | 134.0 |
| AIR PERMEABILITY, cfm/in. ASTM D737 | 199 (4 mm) |
| TABER ABRASION, cycles ASTM D3884 | 1100+ |
| SURFACE ABRASION @ 12 kPA pressure, cycles BS 5690:1988, Martindale | 45,000 |

It is noted that all three of these specific examples have both machine and cross-direction tensile strengths well in excess of the minimal tensile strengths specified in the strength specifications. Also the fabrics are light weight being within the weight per square yard range of the specifications.

The fabric with the extremely high mechanical properties indicated is then fabricated into various buffs as illustrated in FIGS. 5–14.

Figure 5:
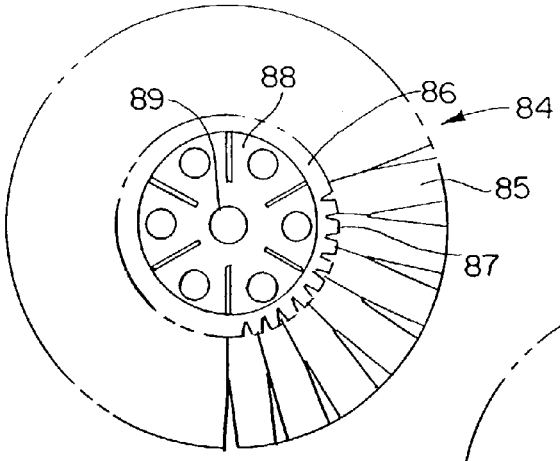
FIG. 5 illustrates a double finger wheel buff in accordance with the present invention.

Referring initially to FIG. 5 there is illustrated a double finger buff shown generally at 84. The fabric in one or more layers is folded into fingers illustrated at 85 usually around a core ring. A clinch ring shown at 86 includes teeth folded inwardly at 87 to bite into the fabric as the ring is clinched about the fold. The buff is then fitted with a core plate 88 which includes an arbor hole 89.

The buffs of FIG. 5 are employed where flexibility is required for irregular shapes and the number of fingers and sewing per finger can be varied depending upon the specific application. The double finger buffs illustrated are used for cut-down and color on all metals where deep penetration is needed as in lapping or mush buffing. The buff may be approximately 24 inches in diameter with the fabric projecting 12 inches from the clinch ring. Such buffs may be made with all fabric fingers or with fabric and sisal fingers, or other blends.

Figure 6:
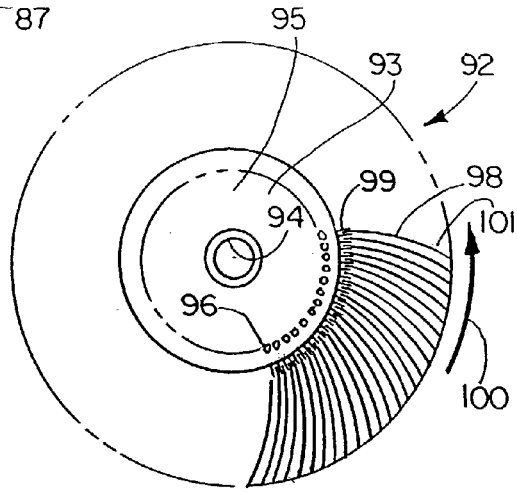
FIG. 6 illustrates a flap wheel in accordance with the present invention.

Referring now to FIG. 6 there is illustrated a flap wheel shown generally at 92 which includes a hub 93 having an arbor hole 94. The hub includes axially spaced circular side walls 95 between which extends a circular row of hinge pins shown generally at 96.

The fabric of the invention shown at 98 is folded about the hinge pins in one or more layers and held in place by U-shape retainers shown generally at 99. Thus each folded fabric flap pack is hinged to the periphery of the hub and the fabric may be configured to project in the non-radial or curved condition only so that as the tool rotates in the direction of the arrow 100 the leading flap side 101 of the fabric flap will be dragged over the work. Flap wheels may be formed with the fabric of the present invention alone or in mixtures with coated abrasives or blends of the non-woven fabric and a combination of coated abrasives in different mineral compositions, backings and grit sizes.

Flap wheels provide the ability to maintain a uniform finish throughout the life of the fabric or blend packs which are hinged to the periphery of the hub. The packs are replaceable in the hub. Flap wheels may have an outside diameter of 20 inches or more and may be approximately 6 inches in width.

Figure 7:
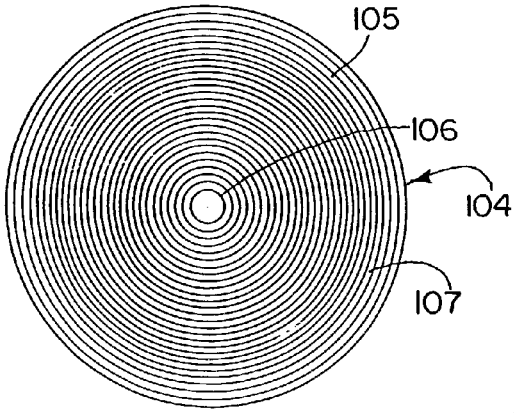
FIG. 7 illustrates a stitched full disc buff in accordance with the present invention.

Referring now to FIG. 7 there is illustrated a stitched full disc buff shown generally at 104 which comprises a plurality of layers 105 of fabric according to the present invention in the circular form shown. Each fabric disc is provided with arbor hole 106. The fabric discs are aligned and held together by circular rows of stitching seen at 107. The stitching used in stitched full disc buffs may vary. The stitching may either be in the concentric rows illustrated or it may be in a spiral form. Another type of stitching is straight spoke or radial arc stitching which is used for special applications. Also the stitching may be omitted except for one row of sewing around the arbor hole. This type of buff is known as a loose fold disc buff. The buffs are relatively soft and flexible and ideal for reaching uneven surfaces while buffing or coloring metals, hard rubber, marble and plastics. Full disc buffs are used effectively in the metal finishing industry and are suited for many cut and color applications as well as a flexible platform for satin finishing.

Figure 8:
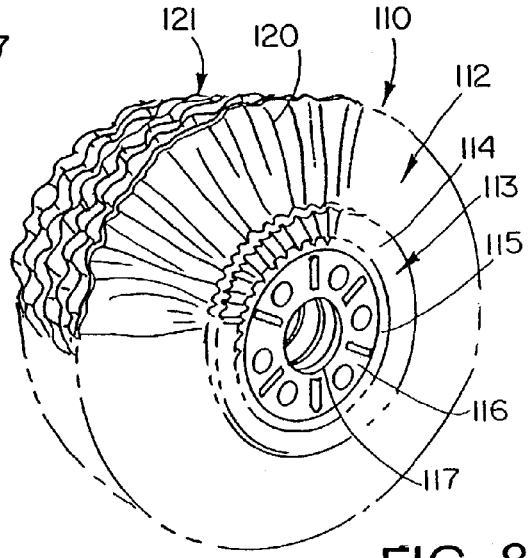
FIG. 8 illustrates a stacked buff roll in accordance with the present invention.

Referring now to FIG. 8 there is illustrated a buff roll shown generally at 110 which is made of series of stacked buffs shown at 112 with or without spacers such as shown at 113. The spacers may comprise worn buff units with the projecting fabric 114 considerably shorter than the normal projection of the fabric in the stacked buffs 112. Each of the buff units as well as the spacers is provided with a clinch ring gripping the interior of the radially projecting fabric shown at 115 and is also fitted with a core plate 116 with the core plates having aligned arbor holes 117.

The fabric projecting from the individual buff wheels is folded or puckered as indicated at 120 so that the face of each individual wheel flares outwardly but is somewhat compressed as the buff wheel sections are stacked and compressed together. The buff wheel sections stacked together to form the roll forms a wider working face shown generally at 121 which is entirely dependant upon the number of buffs with or without spacers forming the buff roll. The various wheels and spacers may be held together by the adjustable clamps or bands illustrated in the co-pending application of Michael Glenn DeHart, Ser. No. 09/375,577 filed Aug. 17, 1999 and entitled *Buff Section Assembly and Method of Making*, now U.S. Pat. No. 6,295,687. Buff rolls of considerable length may also be made by spiral winding the buff material on a core. Buff rolls may typically be four feet or longer and provide flexibility needed for lapping and cleanup and non-streaking benefits. The buff rolls may by either all fabric or fabric and sisal or other blend construction.

Figure 9:
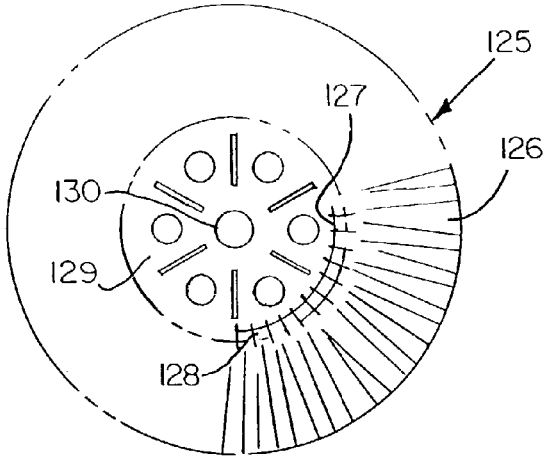
FIG. 9 is illustration of a heavy duty buff in accordance with the invention made with overlapping fingers.

Referring now to FIG. 9 there is generally illustrated at 125 a CHURCHILL® type finger buff. CHURCHILL is a registered trademark of Jason Incorporated of Conover, N.C. The buff comprises radially projecting folded fabric fingers 126 which may be sewn radially. The fingers overlap at their radially inner ends shown at 127 and are stapled as indicated at 128 to the periphery of core disc 129 provided with arbor hole 130. The buff of FIG. 9 is used for heavy duty buffing operations involving steel or aluminum parts and the overlapping finger construction provides a substantial flexibility for curved or flat surfaces. The fingers may be constructed of the non-woven fabric in combination with, for example, sisal twine.

Figure 10:
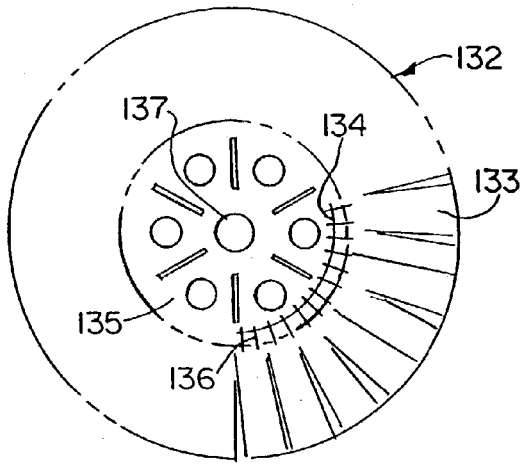
FIG. 10 is a similar buff made of unsewn folded cloth fingers designed to flare out to the working surface.

FIG. 10 illustrates another form of CHURCHILL® finger buff shown generally at 132. The buff is made of unsewn folded fabric fingers shown generally at 133 designed to flare out at the point of contact with the work piece. Again the inner end of the fingers indicated at 134 is stapled to the periphery of core plate 135 by the staples 136. The buff of FIG. 10 is excellent for buffing sloped and curved parts. The finger action of the buff is such that only the finger in contact with the part is deflected allowing the next finger to provide maximum cut. The diameter of the buffs illustrated in FIGS. 9 and 10 may range to 18 inches or more.

Figure 11:
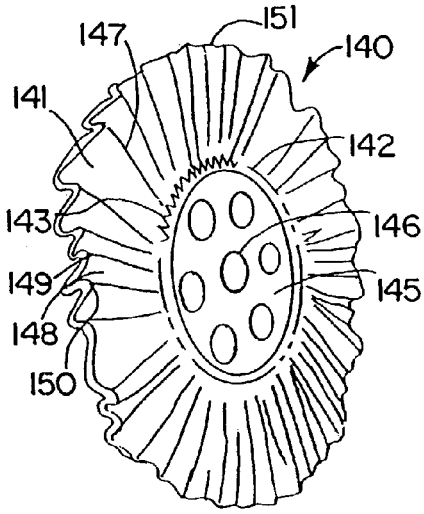
FIG. 11 is a perspective view of an airway buff using pleated fabric in accordance with the present invention.
Figure 12:
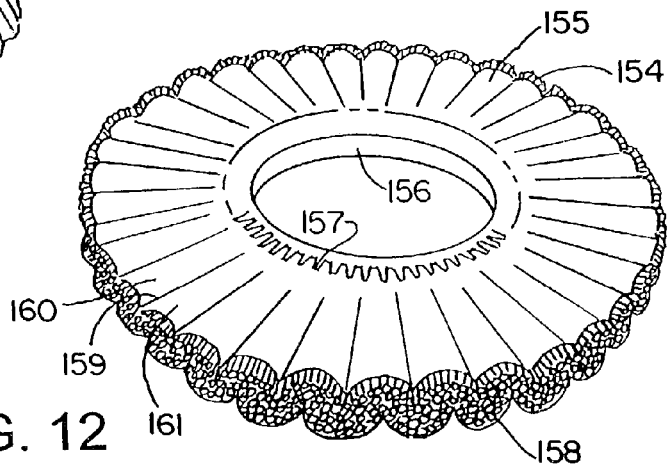
FIG. 12 illustrates a wave ring buff in accordance with the invention.

Referring now to FIG. 11 there is illustrated at 140 what is known as an AIRWAY buff. The buff fabric indicated at 141 is folded around a core ring inside an annular clinch channel 142 which is provided with teeth 143 biting into the fabric radially beyond the core ring. A core plate 145 is fitted within the clinch channel and is provided with a center arbor hole 146.

As illustrated, the fabric of the buff wheel in FIG. 11 is substantially pleated or folded as indicated at 147 so that the axially opposite faces of the fabric provide many relatively deep valleys 148 between adjacent ridges 149 and 150. When the buff is rotated at substantial speed it acts like a fan blowing air radially outwardly toward the work face 151 and of course the work.

In FIG. 10 there is illustrated at 154 what is known as a WAVE RING buff. The fabric shown at 155 is folded around a core and held in place by a clinch ring 156 provided with teeth 157 biting into the fabric beyond the core about which the fabric is folded. The fabric layers are folded to assume an almost regular sine-curve pattern when viewed from the working face 158. Thus each axial face of the wheel is provided with radially extending valleys 159 separated by adjacent ridges 160 and 161. The WAVE RING buff of FIG. 12 also provides a fan-like action moving the air radially to the working face 158. The fabric of the buff of FIGS. 11 and 12 may be a combination of various types of fabric. The various layers of fabric provide a working face of substantial axially width. The buffs of FIGS. 11 and 12 may be used for buffing plumbing products, lighting and door hardware, musical instruments, tubes, cookware, display cases, sheet stock, extrusions, furniture, motorcycle parts, automotive parts, boat parts, hand tools and many others.

Figure 13:
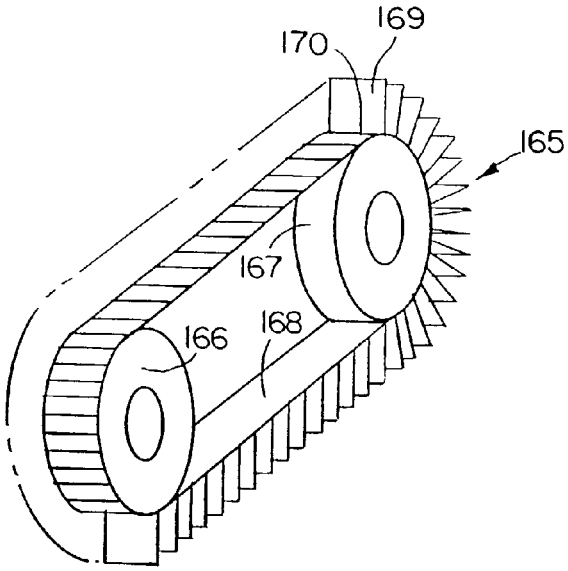
FIG. 13 illustrates a flap belt buffing tool of the invention.

Referring now to FIG. 13 there is illustrated generally at 165 what is known as a flap belt. The tool of FIG. 13 comprises two pulleys shown generally at 166 and 167 about which is trained a belt 168. One of the pulleys is of course power driven. Secured to the belt to project outwardly therefrom are a plurality of flaps shown generally at 169. The flaps then comprise one or more layers of folded fabric material which are secured at the fold to the outer side of the belt as indicated at 170. The flaps may be secured to the belt relatively spaced to provide a light density belt tool or more closely spaced to provide a high density flap belt.

Figure 14:
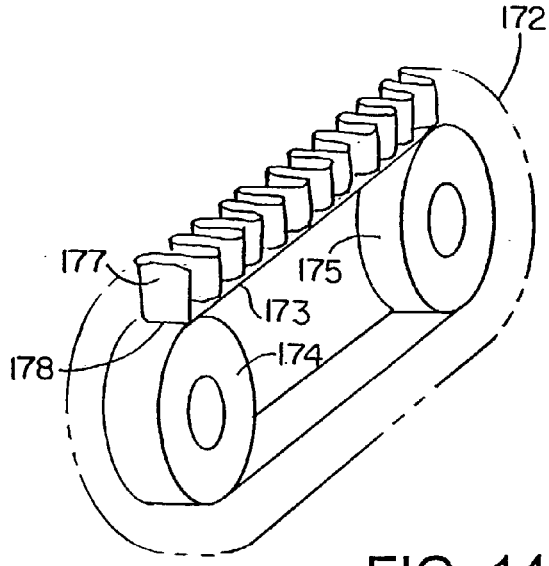
FIG. 14 illustrates another buffing belt of the invention.

In FIG. 14 there is illustrated a similar tool shown generally at 172 comprising a belt 173 trained about pulleys 174 and 175, one of which is power driven. The fabric in one or more layers shown generally at 177 is folded back and forth and secured at its inner edge 178 to the exterior of the belt. The bunching of the fabric folds determines the fabric density of the working face of the tool.

Figure 15:
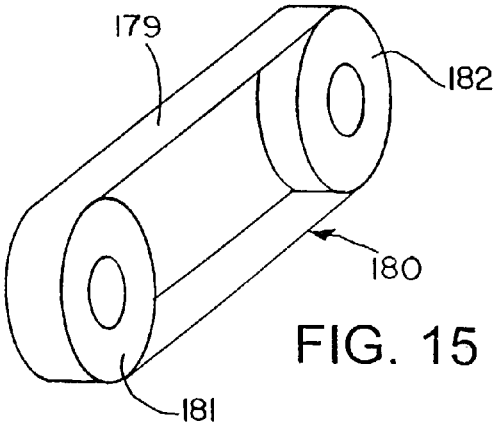
FIG. 15 illustrates a further more simplified belt using one or more plys of the fabric to form the belt.

In FIG. 15 one or more plys of the high strength fabric shown at 179 are formed into belt 180 and trained about pulleys 181 and 182, one of which is power driven. The work is held against the moving belt.

Figure 16:
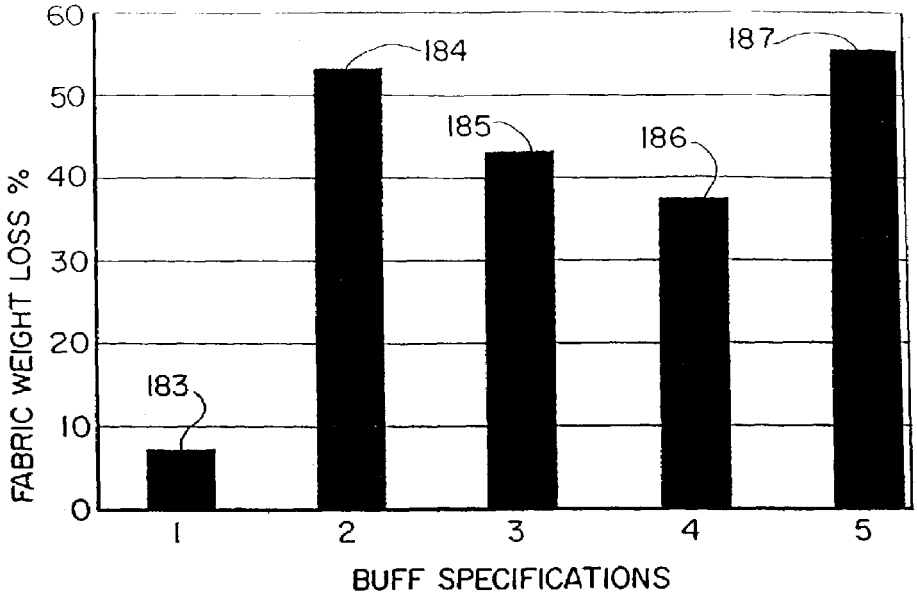
FIG. 16 is a bar chart of a test of the present invention against standard buffs showing fabric weight loss percentages.

Referring now to FIG. 16 there is illustrated in bar chart form the results of tests of the present invention against certain standard buffs. The buff specification number 1 in the chart shown at bar 183 is a test of a buff in accordance with the present invention and the vertical extent of the bar illustrates the fabric weight loss percentage as the result of the test. The buff specifications 2–5 shown at bars 184–187 are tests of standard buffs. The test parameters and the test results of the buffs illustrated in FIG. 16 are shown on the chart set forth below.

As can be seen from the chart above each of the various buffs was run at the same spindle speed, each generating a surface speed of 5,026 feet per minute, almost a mile a minute, and each buff was run for period of two hours. The amp load at the start and end was measured as well as the temperature range start and end. The columns above list the start weight, ending weight, the fabric weight loss quantity, and the fabric weight loss percentage which is reflected in the bars of FIG. 16. Also measured was the ending diameter reflected in the diameter-off column with the loss being the actual loss in diametral inches. Accordingly, the buff with the fabric of the present invention had a fabric weight loss of 7.2% and an actual diameter loss of one quarter of an inch. The other buffs tested lost 6 ½ inches, five inches, four inches and six inches respectively.

Figure 17:
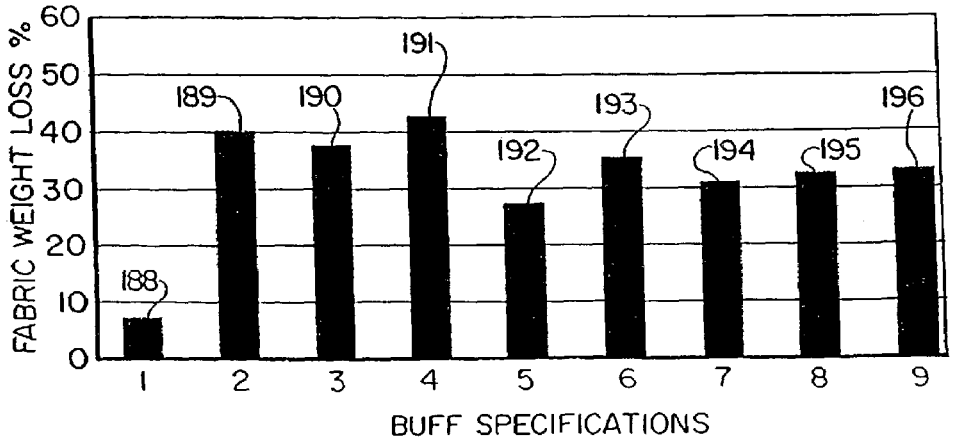
FIG. 17 is a bar chart of a similar test against mill treatment buffs.

A similar test with the fabric weight loss percentages is shown in FIG. 17, with the test being the present invention against certain standard mill treatment buffs. In FIG. 17 the bar 1 shown at 188 represents the percentage weight loss of a buff of the present invention. The bars shown at 189–196 and indicated as buff specifications 2–9 indicate the percentage weight loss of various conventional mill treatment buffs as tested according to the following chart.

As can be seen again from the chart each of the buffs was driven at the same spindle speed generating the surface speed of 5,026 feet per minute. Each buff also was 16 inches in diameter. The chart lists the amp load start and end, the temperature range start and end, the run time, the start weight, the ending weight, the fabric weight loss quantity, the fabric weight percentage which is reflected in the bars of FIG. 17, with the final two columns showing the actual reduction in the diameter of the tool with the actual diametral loss indicated in the last column.

The one conclusion which can be drawn from the tests indicated above is that the buff of the present invention has significantly better wear characteristics than the tested conventional buffs and that the temperature generated by the buff is within comparable or lower norms. The weight loss is less than ten (10) percent or less than one inch of diameter.

The fabric of the present invention and as used in the above noted tests may be purchased from Polymer Group Inc. of Benson, N.C. to the specifications noted. Also, reference may be had to copending application Ser. No. 60/209,398, subsequently published as US2002/0023326, for a further disclosure of the fabric of the present invention and its manufacture.

It can now be seen that there is provided a buff made from such non-woven fabric by a hydroentanglement process on a topographical surface.

With the fabric a variety of buffing tools are made in wheel belt or roll form. The tests against standard and mill treatment buffs show a remarkably lower fabric weight loss percentage with generally lower or acceptable operating temperatures. The fabric has exceptional mechanical strengths having a tensile strength in excess of 650 N/50 mm according to DIN 29073/3. Preferably the fabric has a tensile strength of at least 1,000 N/50 mm in the machine direction and in excess of 900 N/50 mm in the cross-direction according to such DIN.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only be the scope of the claims.

The invention claimed is:

1. A power driven low heat generating buffing tool comprising a light weight non-woven fabric having a tensile strength as a whole in excess of 650 N/50 mm according to DIN 29073/3, and wherein the fabric has a machine direction and a cross direction, and has a tensile strength as a whole in excess of 700 N/50 mm in the machine direction, and as a whole in excess of 650 N/50 mm in the cross direction according to said DIN.

2. A buffing tool as set forth in claim 1 wherein said fabric has a tensile strength as a whole in the machine direction of at least 1,000 N/50 mm, and as a whole in excess of 900 N/50 mm in the cross direction according to said DIN.

3. A low heat generating buffing tool comprising a light weight non-woven fabric having a tensile strength in excess of 650 N/50 mm according to DIN 29073/3, wherein said buffing tool is a wheel and has a fabric weight loss of less than ten (10) percent when run at a surface speed of about 5,000 feet per minute for two hours.

4. A low heat generating buffing tool comprising a light weight non-woven fabric having a tensile strength in excess of 650 N/50 mm according to DIN 29073/3, and wherein said buffing tool is a wheel having a diameter, and has a diameter loss of less than one inch when run at a surface speed of about 5,000 feet per minute for a duration of two hours.

5. Buffing tool as set forth in claim 4 wherein said tool has a diameter loss of less than one half inch when run at said speed for said duration.

6. A low heat generating buffing tool comprising a light weight non-woven fabric having a tensile strength as a whole in excess of 650 N/50 mm according to DIN 29073/3, the fabric having a machine direction and a cross direction, with the fabric as a whole having a tensile strength in excess of 700 A/50 mm in the machine direction, and wherein said tool includes a core, and said tool is a finger buff, wherein the fabric is folded into fingers to project radially from the core.

7. A low heat generating buffing tool comprising a light weight non-woven fabric having a tensile strength as a whole in excess of 650 N/50 mm according to DIN 29073/3, the fabric having a machine direction and a cross direction, with the fabric as a whole having a tensile strength in excess of 700 A/50 mm in the machine direction, and wherein said tool includes a hub, and said fabric is formed into flap packs extending from the hub.

8. A low heat generating buffing tool comprising a light weight non-woven fabric having a tensile strength as a whole in excess of 650 N/50 mm according to DIN 29073/3, the fabric having a machine direction and a cross direction, with the fabric as a whole having a tensile strength in excess of 700 A/50 mm in the machine direction, and wherein said tool is a disc buff formed of a plurality of layers.

9. A buffing tool as set forth in claim 8 wherein said layers are held together by stitching.

10. A low heat generating buffing tool comprising a light weight non-woven fabric having a tensile strength as a whole in excess of 650 N/50 mm according to DIN 29073/3, the fabric having a machine direction and a cross direction, with the fabric as a whole having a tensile strength in excess of 700 A/50 mm in the machine direction, and wherein said tool is in the form of a wheel and includes clinch rings with the fabric projecting radially from said clinch rings.

11. A buffing tool as set forth in claim 10 wherein the radially projecting fabric is puckered.

12. A buffing tool as set forth in claim 10 wherein the fabric is folded to provide valleys and ridges.

13. A power driven low heat generating buffing tool comprising a light weight non-woven fabric having a tensile strength in excess of 650 N/50 mm according to DIN 29073/3, and said buffing tool has a fabric weight loss of less than ten (10) percent when run at a surface speed of about 5,000 feet per minute for two hours, the fabric being formed as a belt to be driven around at least two pulleys.

14. A buffing tool as set forth in claim 13 wherein said tool is a flap belt.

15. A buffing tool as set forth in claim 13 wherein the fabric is folded and bunched on the belt.

* * * * *